US008791648B2

(12) United States Patent
Luo et al.

(10) Patent No.: US 8,791,648 B2
(45) Date of Patent: Jul. 29, 2014

(54) LED DRIVER CIRCUITS WITH CURRENT ENVELOPE CONTROL

(75) Inventors: Zheng Luo, San Jose, CA (US); Eric Yang, Saratoga, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 149 days.

(21) Appl. No.: 13/443,350

(22) Filed: Apr. 10, 2012

(65) Prior Publication Data

US 2013/0264964 A1 Oct. 10, 2013

(51) Int. Cl.
*H05B 37/02* (2006.01)

(52) U.S. Cl.
USPC ..... 315/291; 315/307; 315/308; 315/193; 315/312; 315/185 R

(58) Field of Classification Search
USPC ..... 315/185 R, 192, 193, 210, 294, 315/307–308, 320; 345/82–84, 102, 690, 345/211
See application file for complete search history.

(56) References Cited

U.S. PATENT DOCUMENTS

2010/0033109 A1* 2/2010 Liu et al. ..... 315/294
2011/0254462 A1* 10/2011 Ruan et al. ..... 315/291

* cited by examiner

*Primary Examiner* — Thienvu Tran
*Assistant Examiner* — Christopher Lo
(74) *Attorney, Agent, or Firm* — Okamoto & Benedicto LLP

(57) ABSTRACT

A light emitting diode (LED) driver circuit controls switching of an output transistor. The LED driver circuit monitors inductor current flowing through an output inductor that is coupled to one or more LEDs. In response to detecting that the inductor current has reached a peak value, the LED driver circuit switches OFF the output transistor. The LED driver circuit switches ON the output transistor in response to detecting zero crossing of the inductor current. The LED driver circuit may detect zero crossing of the inductor current from a gate voltage of the output transistor by detecting for a negative spike.

18 Claims, 3 Drawing Sheets

LED DRIVER CIRCUITS WITH CURRENT ENVELOPE CONTROL

BACKGROUND OF THE INVENTION

1. Field of the Invention

The present invention relates generally to electrical circuits, and more particularly but not exclusively to LED driver circuits.

2. Description of the Background Art

Light emitting diodes (LEDs) are employed in various applications involving illumination including flat screen backlighting, lamps, and other lighting applications. Conventional LED driver circuits operate in fixed frequency or constant off time, either in constant conduction mode (CCM) or discontinuous conduction mode (DCM). To be competitive in today's market, an LED driver circuit needs to be cost and energy efficient. Unfortunately, currently available LED driver circuits are not energy efficient, and need components that are relatively large not only in number but also in physical size as mounted on a printed circuit board.

SUMMARY

In one embodiment, a light emitting diode (LED) circuit comprises a plurality of LEDs, an output inductor coupled to the plurality of LEDs, an output transistor coupled to the output inductor, and an LED driver circuit coupled to a gate of the output transistor, the LED driver circuit being configured to control switching of the output transistor, to detect an inductor current flowing through the output inductor, to switch OFF the output transistor in response to detecting the inductor current increasing to a peak value, and to switch ON the output transistor in response to detecting zero crossing of the inductor current.

In another embodiment, an LED driver circuit comprises: (a) a first comparator configured to detect zero crossing of an inductor current that flows through an output inductor coupled to a plurality of LEDs, the first comparator being configured detect the zero crossing of the inductor current from a gate voltage of an output transistor coupled to the output inductor; (b) a second comparator configured to detect when the inductor current has increased to a peak value; and (c) a drive control circuit configured to switch ON the output transistor in response to detection of the zero crossing of the inductor current and to switch OFF the output transistor in response to detection that the inductor current has increased to the peak value.

In another embodiment, a method of driving an LED includes monitoring inductor current flowing through an output inductor coupled to the LED. In response to detecting that the inductor current has increased to a peak value, an output transistor coupled to the output inductor is switched OFF. The output transistor is switched ON in response to detecting zero crossing of the inductor current.

These and other features of the present invention will be readily apparent to persons of ordinary skill in the art upon reading the entirety of this disclosure, which includes the accompanying drawings and claims.

The use of the same reference label in different drawings indicates the same or like components.

DETAILED DESCRIPTION

In the present disclosure, numerous specific details are provided, such as examples of circuits, components, and methods, to provide a thorough understanding of embodiments of the invention. Persons of ordinary skill in the art will recognize, however, that the invention can be practiced without one or more of the specific details. In other instances, well-known details are not shown or described to avoid obscuring aspects of the invention.

Figure 1:
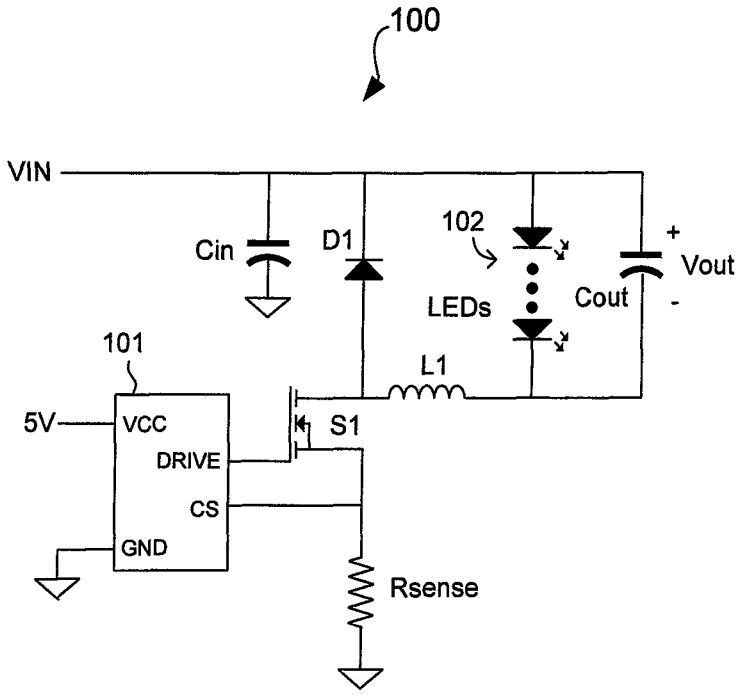
FIG. 1 shows a schematic diagram of an LED circuit in accordance with an embodiment of the present invention.

FIG. 1 shows a schematic diagram of an LED circuit 100 in accordance with an embodiment of the present invention. In the example of FIG. 1, the LED circuit 100 comprises an LED driver circuit 101, an input capacitor Cin, an output capacitor Cout, a diode D1, a string of LEDs 102, an output inductor L1, an output transistor S1, and a sense resistor Rsense.

In the example of FIG. 1, the LED circuit 100 receives an input voltage VIN that is filtered by the input capacitor Cin to provide a DC voltage on the cathode of the diode D1. The input voltage VIN may be a rectified voltage from a bridge rectifier (not shown). The output voltage VOUT of the LED circuit 100 is across the capacitor Cout.

In the example of FIG. 1, the LED driver circuit 101 comprises an integrated circuit (IC) having VCC, ground (GND), DRIVE, and current sense (CS) pins. The LED driver circuit 101 may include other pins for other features, such as dimming control. The supply voltage provided to the VCC pin is 5V for illustration purposes only. The LED driver circuit 101 may also be implemented as a discrete circuit.

The DRIVE pin of the LED driver circuit 101 is coupled to the gate of the transistor S1. In the example of FIG. 1, the transistor S1 comprises an N-channel MOSFET. Accordingly, the LED driver circuit 101 switches the transistor S1 ON by providing a high signal on the gate of the transistor S1, and switches the transistor S1 OFF by providing a low signal on the gate of the transistor S1. As can be appreciated, the voltage level and polarity for switching the transistor S1, and other transistors in this disclosure, may be varied depending on the type of the transistor employed.

When the LED driver circuit 101 switches the transistor S1 ON, the inductor current, i.e., the electrical current through the output inductor L1, flows through the LEDs 102, the output inductor L1, the transistor S1, and the resistor Rsense. The voltage across the resistor Rsense is thus indicative of the inductor current, which dictates the brightness of the LEDs 102. The LED driver circuit 101 detects the voltage across the resistor Rsense by way of the CS pin coupled to the source of the transistor S1. The inductor current increases while the transistor S1 is ON. In response to detecting that the inductor current has increased to a level of a regulated peak threshold, the LED driver circuit 101 switches the transistor S1 OFF by providing a low signal on the gate of the transistor S1. The inductor current flows through the LEDs 102, the output inductor L1, and the diode D1 when the transistor S1 is OFF.

The inductor current decreases when the transistor S1 is OFF. Monitoring of the inductor current by way of the CS pin is no longer possible at this time because the output inductor L1 is decoupled from the resistor Rsense when the transistor S1 is OFF. As will be more apparent below, the LED driver circuit 101 monitors the gate voltage of the transistor S1 by way of the DRIVE pin to detect zero crossing of the inductor current, i.e., when the inductor current decreases to zero. In response to detecting zero crossing of the inductor current, the LED driver circuit 101 switches the transistor S1 back ON, and the cycle repeats.

As can be appreciated from the foregoing, the transistor S1 is switched ON when the inductor current becomes zero and is switched OFF when the inductor current reaches a peak value, thereby creating an inductor current envelope. Because the current through the LEDs 102 is the average of the inductor current and the inductor current envelope has a well defined shape, the resulting LED current through the LEDs 102 is regulated and predictable to be half of the peak inductor current. This advantageously provides uniform illumination, better efficiency, and smaller size output inductor compared to currently available solutions.

Figure 2:
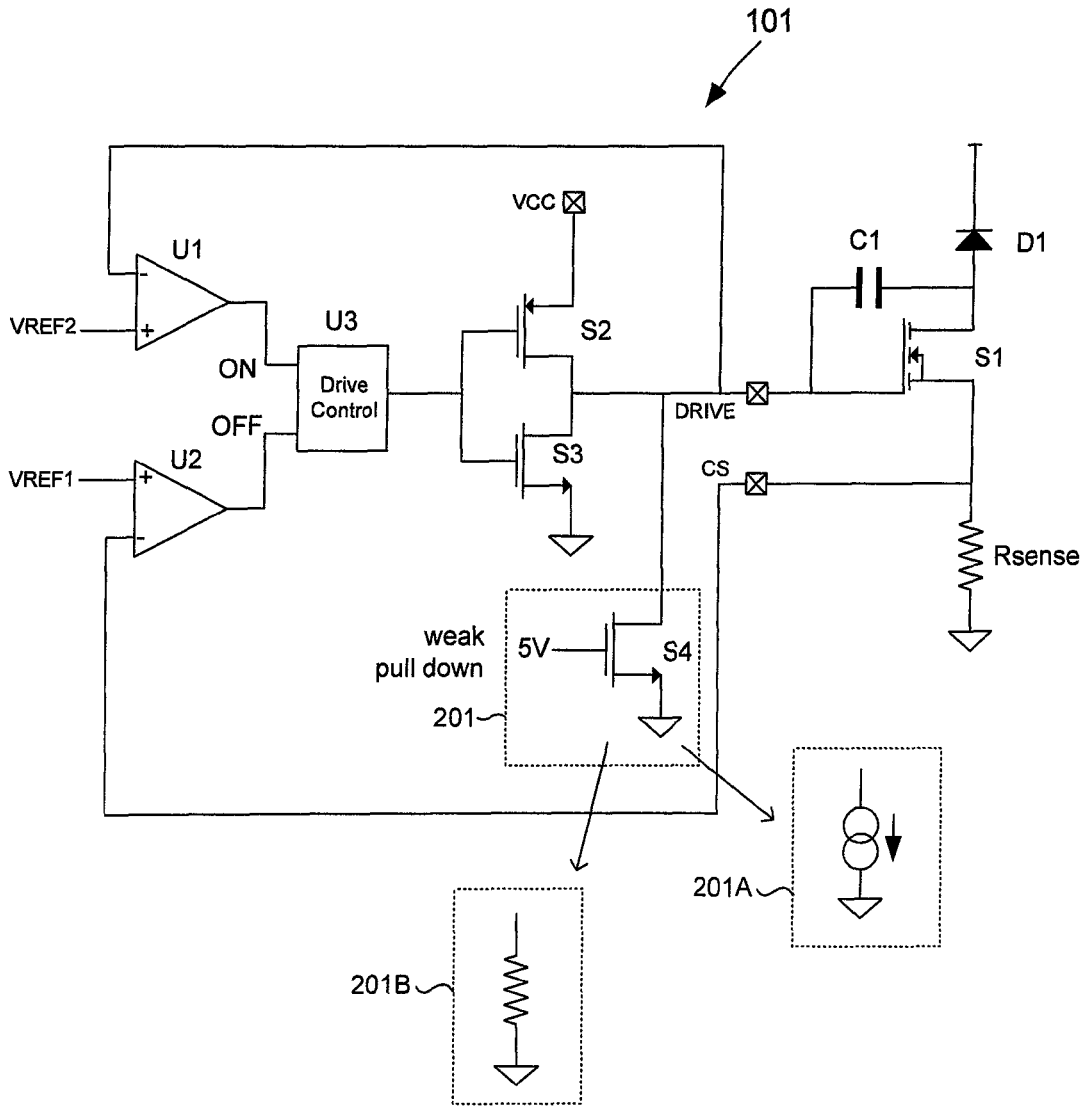
FIG. 2 shows additional details of an LED driver circuit in the LED circuit of FIG. 1 in accordance with an embodiment of the present invention.

FIG. 2 shows additional details of the LED driver circuit 101 in accordance with an embodiment of the present invention. In the example of FIG. 2, the LED driver circuit 101 comprises a transistor S2, a transistor S3, a drive control circuit U3, a zero crossing detector comprising a weak pull down circuit 201 and a comparator U1, and a peak inductor current detector comprising a comparator U2. FIG. 2 also shows the previously introduced VCC, DRIVE, and CS pins of the LED driver circuit 101.

FIG. 2 shows a capacitor C1 coupled across the gate and drain of the transistor S1. In one embodiment, the capacitor C1 is the Miller capacitance of the transistor S1. As can be appreciated, the Miller capacitance is the parasitic capacitance between the drain and the gate of the transistor S1, and is not a separate component. In other embodiments, the capacitor C1 is a separate capacitor (as opposed to a parasitic capacitance). The LED driver circuit 101 takes advantage of the capacitor C1 to detect zero crossing of the inductor current by way of the DRIVE pin during the time the transistor S1 is in the OFF state. Also shown in FIG. 2 are the previously introduced diode D1 and resistor Rsense. Other components of the LED circuit 100 are not shown in FIG. 2 for clarity of illustration.

When the transistor S1 is ON, the inductor current flows through the transistor S1 and develops a voltage across the resistor Rsense. To detect the peak of the inductor current, the comparator U2 compares the voltage across the resistor Rsense to a reference voltage VREF1. The value of the resistor Rsense and the level of the reference voltage VREF1 may be selected for a particular peak value of inductor current. This advantageously allows adjustment of the inductor current envelope in the field by a customer. When the voltage across the resistor Rsense exceeds the reference voltage VREF1, i.e., the inductor current has increased to the peak threshold, the comparator U2 outputs an OFF control signal (a high signal in this example) to the drive control circuit U3 to indicate detection of the peak of the inductor current. In response to detecting the peak of the inductor current, the drive control circuit U3 outputs a high signal to the buffer circuit comprising the transistors S2 and S3.

A high signal from the drive control circuit U3 switches OFF the transistor S2 and switches ON the transistor S3. The transistor S3 pulls down the gate of the transistor S1 when the transistor S3 is in the ON state. The transistor S3 provides a strong pull down in that it pulls down the gate of the transistor S1 to ground by way of a low impedance path. After a predetermined delay time, the drive control circuit U3 floats its output, i.e., leaving its output in a high impedance state. This results in both the transistors S2 and S3 being in the OFF state. During the time when both the transistors S2 and S3 are OFF, the weak pull down circuit 201 weakly pulls down the gate of the transistor S1 to ground to prevent the transistor S1 from switching back ON. The weak pull down circuit 201 provides a weak pull down in that it still presents a relatively high impedance to the gate of the transistor S1. For example, while the transistor S3 may present an impedance of 0.12Ω when in the ON state, the weak pull down circuit 201 may continuously present an impedance of 100 KΩ. As can be appreciated, these values are for illustration purposes only and not meant to be limiting.

In the example of FIG. 2, the weak pull down circuit 201 comprises a transistor S4. In another embodiment, the weak pull down circuit comprises a current source (see 201A). In yet another embodiment, the weak pull down circuit comprises a resistor (see 201B). As shown in FIG. 2, the weak pull down circuit 201 may continuously present on the gate of the transistor S1 a relatively high impedance path to ground. Because the transistor S3 provides a strong pull down, i.e., a low impedance path to ground, when in the ON state, the transistor S3 simply overcomes the high impedance presented by weak pull down circuit 201. The value of the impedance presented by the weak pull down circuit 201 is selected such that the transistor S1 is prevented from switching ON when the transistor S3 is OFF.

The weak pull down circuit 201 advantageously allows detection of zero crossing of the inductor current from the gate voltage of the transistor S1. The inductor current charges the capacitor C1 when the transistor S1 is OFF. However, the voltage on the anode of the diode D1 is clamped to the input voltage VIN. This results in a negative spike on the gate voltage of the transistor S1 when the inductor current crosses zero. The negative spike is detected by the comparator U1 by comparing the gate voltage of the transistor S1 to a reference voltage VREF2. The comparator U1 may be configured to output an ON control signal to the drive control circuit U3 at that time. In another embodiment, the comparator U1 is configured such that after detecting the negative spike, the comparator U1 waits for a ring back on the gate on the transistor before sending an ON control signal to the drive control circuit U3. The ON control signal, which is a high signal in this example, from the comparator U1 indicates detection of zero crossing of the inductor current.

In response to receiving an ON control signal from the comparator U1, the drive control circuit U3 outputs a low signal to the buffer circuit comprising the transistors S2 and S3. The low signal switches ON the transistor S2 and switches OFF the transistor S3. Switching the transistor S2 ON supplies VCC to the gate of the transistor S1, thereby switching the transistor S1 ON. As can be appreciated, the supply voltage VCC overcomes the weak pull down presented by the weak pull down circuit 201 to reliably keep the transistor S1 in the ON state. The inductor current increases when the transistor S1 is ON, and the cycle repeats.

Figure 3:
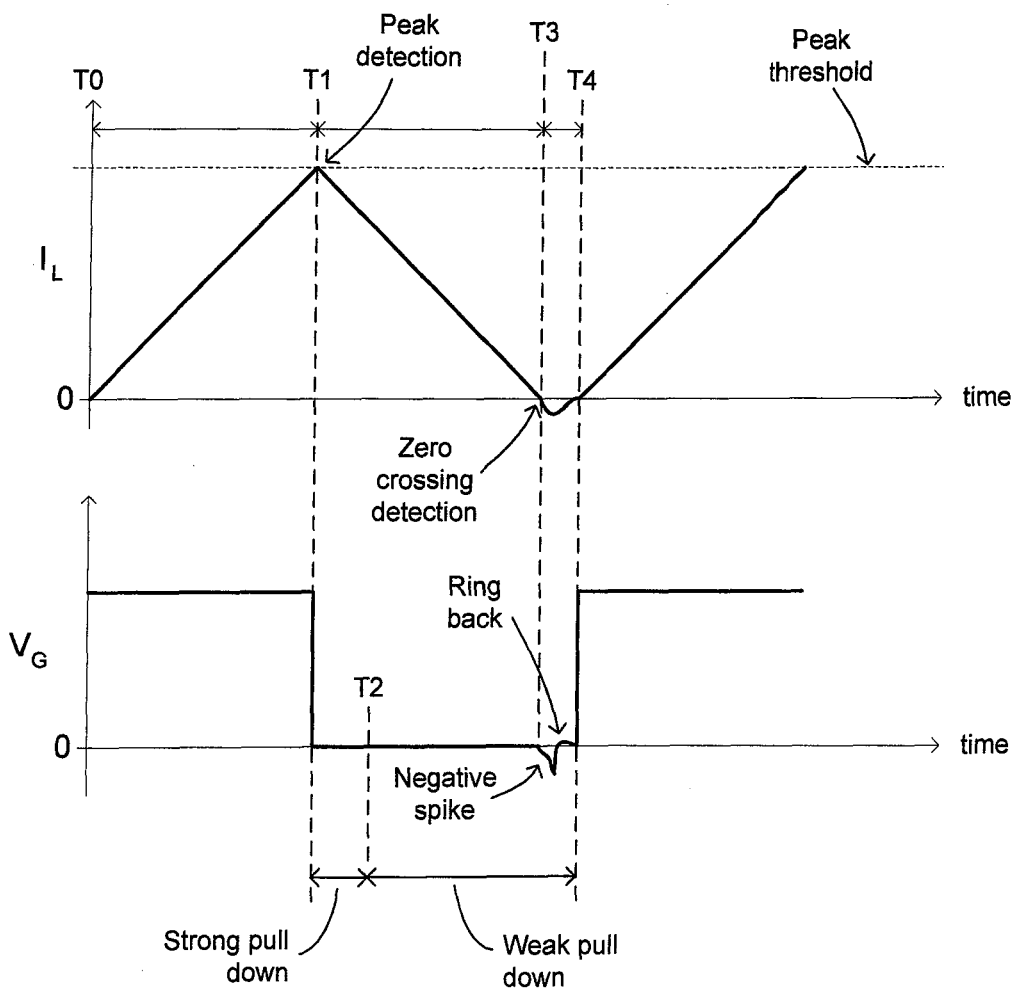
FIG. 3 shows waveforms in the LED circuit of FIG. 1, illustrating a method of driving LEDs in accordance with an embodiment of the present invention.

FIG. 3 shows waveforms in the LED circuit 100, illustrating a method of driving LEDs in accordance with an embodiment of the present invention. The waveforms are explained with reference to the components of the LED circuit 100 for illustration purposes only. In light of the present disclosure, one of ordinary skill in the art will recognize that the waveforms of FIG. 3 may also be generated using other components without detracting from the merits of the present invention.

FIG. 3 shows an example waveform of the inductor current ($I_L$) through the output inductor L1 and an example waveform of the gate voltage ($V_G$) on the gate of the output transistor S1 versus time. In the example of FIG. 3, the gate voltage of the transistor S1 is active, which is a high signal in this example, from time T0 to T1. This places the transistor S1 in the ON state, allowing the inductor current to increase during this time.

At time T1, the peak of the inductor current is detected. In one embodiment, the peak of the inductor current is limited to a peak threshold. When the inductor current increases to be equal to the peak threshold, the peak of the inductor current is deemed to have been detected. In response to detecting the peak of the inductor current, the gate voltage of the transistor S1 is made inactive, which is a low voltage in this example, to switch OFF the transistor S1. In one embodiment, the gate of the transistor S1 is strongly pulled down to ground along a low impedance path for a delay time between time T1 to T2, and weakly pulled down to ground along a high impedance path from time T2. The delay time may be less than 10% of the OFF time from the time T1 to T4, for example. The impedance of the low impedance path is lower than the impedance of the high impedance path. Pulling the gate of the transistor S1 to ground places the transistor S1 in the OFF state.

At time T3, the zero crossing of the inductor current is detected from the gate voltage of the transistor S1. The zero crossing of the inductor current may be detected by monitoring for a negative going voltage spike and/or ring back on the gate voltage of the transistor S1. The negative going spike may start at zero and goes to a negative value. The ring back of the gate voltage from the spike may also be detected to confirm zero crossing of the inductor current. In response to detecting zero crossing of the inductor current, the transistor S1 is switched ON at time T4, thereby allowing the inductor current to increase once again. The cycle continues with the next detection of the peak of the inductor current.

Improved methods and circuits for driving LEDs have been disclosed. While specific embodiments of the present invention have been provided, it is to be understood that these embodiments are for illustration purposes and not limiting. Many additional embodiments will be apparent to persons of ordinary skill in the art reading this disclosure.

What is claimed is:

1. A light emitting diode (LED) circuit comprising:

a plurality of LEDs;

an output inductor coupled to the plurality of LEDs;

an output transistor coupled to the output inductor;

an LED driver circuit coupled to a gate of the output transistor, the LED driver circuit being configured to control switching of the output transistor, to detect an inductor current flowing through the output inductor, to switch OFF the output transistor in response to detecting the inductor current increasing to a peak value, and to switch ON the output transistor in response to detecting zero crossing of the inductor current; and a weak pull down circuit coupled to the gate of the output transistor, wherein the weak pull down circuit is configured to pull down the gate of the output transistor to ground along a first impedance path having an impedance that is higher than that of a second impedance path along which the gate of the output transistor is pulled down to ground when the output transistor is switched OFF by another transistor in the LED driver circuit.

2. The LED circuit of claim 1 wherein the LED driver circuit comprises a zero crossing detector that includes the weak pull down circuit and configured to detect the zero crossing of the inductor current by monitoring for a negative spike on the gate of the output transistor.

3. The LED circuit of claim 2 wherein the zero crossing detector comprises:

a first comparator having a first input coupled to the gate of the output transistor and a second input coupled to receive a first reference voltage, wherein the first comparator is configured to compare a gate voltage on the gate of the output transistor against the first reference voltage to detect the zero crossing of the inductor current.

4. The LED circuit of claim 1 wherein the weak pull down circuit comprises a transistor that is continuously ON.

5. The LED circuit of claim 1 wherein the weak pull down circuit comprises a current source.

6. The LED circuit of claim 1 wherein the LED driver circuit comprises an integrated circuit having a first pin and a second pin, the first pin being coupled to the gate of the output transistor and the second pin being coupled to a source of the output transistor, and the LED driver circuit detects zero crossing of the inductor current by way of the first pin and detects the inductor current increasing to the peak value by way of the second pin.

7. The LED circuit of claim 1 wherein the LED driver circuit detects zero crossing of the inductor current from a gate voltage on the gate of the output transistor.

8. A light emitting diode (LED) driver circuit comprising:

a first comparator configured to detect zero crossing of an inductor current that flows through an output inductor coupled to a plurality of LEDs, the first comparator being configured detect the zero crossing of the inductor current from a gate voltage of an output transistor coupled to the output inductor;

a weak pull down circuit coupled to a gate of the output transistor, wherein the weak pull down circuit is configured to pull down the gate of the output transistor to ground along a first impedance path having an impedance that is higher than that of a second impedance path along which the gate of the output transistor is pulled down to ground when the output transistor is switched OFF by another transistor in the LED driver circuit;

a second comparator configured to detect when the inductor current has increased to a peak value; and a drive control circuit configured to switch ON the output transistor in response to detection of the zero crossing of the inductor current, and to switch OFF the output transistor in response to detection that the inductor current has increased to the peak value.

9. The LED driver circuit of claim 8 further comprising:

a buffer circuit configured to receive a control signal from the drive control circuit and to output a drive signal to the gate of the output transistor to switch the output transistor in accordance with the control signal.

10. The LED driver circuit of claim 8 wherein the LED driver circuit is packaged as an integrated circuit (IC).

11. The LED driver circuit of claim 10 wherein the IC comprises a first pin coupled to the gate of the output transistor and a second pin coupled to a source of the output transistor, the first comparator being configured to receive the gate voltage of the output transistor by way of the first pin to detect the zero crossing of the inductor current, and the second comparator being configured to detect when the inductor current has increased to the peak value by way of the second pin.

12. A method of driving a light emitting diode (LED), the method comprising:

monitoring inductor current flowing through an output inductor coupled to the LED;

detecting that the inductor current has increased to a peak value;

in response to detecting that the inductor current has increased to the peak value, switching OFF an output transistor coupled to the output inductor;

detecting zero crossing of the inductor current; and in response to detecting the zero crossing of the inductor current, switching ON the output transistor;

wherein switching OFF the output transistor comprises:

pulling down a gate of the output transistor to ground along a first impedance path during a first time period; and pulling down the gate of the output transistor to ground along a second impedance path during a second time period following the first time period, the first impedance path having an impedance that is lower than that of the second impedance path.

13. The method of claim 12 wherein detecting that the inductor current has increased to the peak value comprises:

detecting a voltage on a sense resistor to which the inductor current flows; and comparing the voltage on the sense resistor against a first reference voltage to detect that the inductor current has increased to the peak value.

14. The method of claim 12 wherein detecting the zero crossing of the inductor current comprises:

detecting a gate voltage on the gate of the output transistor; and comparing the gate voltage on the gate of the output transistor against a second reference voltage to detect the zero crossing of the inductor current.

15. The method of claim 12 wherein detecting the zero crossing of the inductor current comprises:

detecting a negative spike on the gate of the output transistor to detect the zero crossing of the inductor current.

16. The method of claim 12 wherein the LED is in series with a plurality of LEDs.

17. The method of claim 12 wherein detecting the zero crossing of the inductor current comprises:

detecting a negative spike on the gate of the output transistor; and detecting a ring back on the gate of the output transistor after detecting the negative spike.

18. The method of claim 12 further comprising:

monitoring a voltage on a source of the output transistor through a first pin of an integrated circuit to detect that the inductor current has increased to the peak value; and monitoring a voltage on the gate of the output transistor through a second pin of the integrated circuit to detect the zero crossing of the inductor current.

* * * * *